US006792069B2

(12) United States Patent
Hirabayashi et al.

(10) Patent No.: US 6,792,069 B2
(45) Date of Patent: Sep. 14, 2004

(54) APPARATUS FOR INSPECTING A HEAT EXCHANGER TUBE AND GROUP OF HEAT EXCHANGER TUBES

(75) Inventors: Masaru Hirabayashi, Ibaraki-ken (JP); Kuniaki Ara, Ibaraki-ken (JP); Hitoshi Hayashida, Ibaraki-ken (JP)

(73) Assignee: Japan Nuclear Cycle Development Institute, Ibaraki-ken (JP)

( * ) Notice: Subject to any disclaimer, the term of this patent is extended or adjusted under 35 U.S.C. 154(b) by 29 days.

(21) Appl. No.: 10/230,259

(22) Filed: Aug. 29, 2002

(65) Prior Publication Data

US 2003/0118150 A1 Jun. 26, 2003

(30) Foreign Application Priority Data

Dec. 26, 2001 (JP) ..... 2001-393383

(51) Int. Cl.[7] ..... G01B 15/06
(52) U.S. Cl. ..... 378/58; 378/4; 378/59
(58) Field of Search ..... 378/58, 59, 4–20; 250/358.1, 393

(56) References Cited

U.S. PATENT DOCUMENTS 3,872,310 A * 3/1975 Charlton et al. ..... 378/56
3,906,358 A * 9/1975 Stone ..... 324/220
3,958,120 A * 5/1976 Ward ..... 378/59
4,274,005 A * 6/1981 Yamamura et al. ..... 378/9
4,567,012 A * 1/1986 Radcliff ..... 376/245
4,680,470 A * 7/1987 Heald ..... 250/358.1
4,770,053 A * 9/1988 Broderick et al. ..... 73/866.5
5,614,720 A * 3/1997 Morgan et al. ..... 250/360.1

* cited by examiner

*Primary Examiner*—Craig E. Church
*Assistant Examiner*—Jurie Yun
(74) *Attorney, Agent, or Firm*—Wenderoth, Lind & Ponack, L.L.P.

(57) ABSTRACT

An apparatus for non-destructively inspecting an arbitrary heat exchanger tube among a group of heat exchanger tubes. The apparatus includes a radiation detector inserted in a heat exchanger tube to be inspected, at least one radiation source inserted in a plurality of heat exchanger tubes surrounding the heat exchanger tube to be inspected, and a CT processing unit. A cross section of the heat exchanger tube to be inspected is imaged by the CT processing. Also, by setting at least one radiation source in an inner portion of the heat exchanger tube, on the inner side of a group of heat exchanger tubes or on the outer side of the group of heat exchanger tubes, and by setting at least one radiation detector carrying a collimator on the outer side of the group of heat exchanger tubes, a cross section of the group of heat exchanger tubes can be imaged by the CT processing.

5 Claims, 6 Drawing Sheets

APPARATUS FOR INSPECTING A HEAT EXCHANGER TUBE AND GROUP OF HEAT EXCHANGER TUBES

BACKGROUND OF THE INVENTION

The present invention relates to an apparatus for non-destructively inspecting a heat exchanger tube and a group of heat exchanger tubes, and more particularly to an apparatus for inspecting a heat exchanger tube or a group of heat exchanger tubes for a defect by imaging a cross section thereof by CT (Computed Tomography) processing by utilizing radiations. This technique is suitably applied to the diagnosing of a defect of a heat exchanger tube used in, for example, a heat exchanger, a steam generator, a boiler and the like.

A heat exchanger and a steam generator and the like generally have a structure in which a group of heat exchanger tubes constructed by arranging and bundling a multiplicity of heat exchanger tubes are incorporated in a container. The use of these heat exchanger tubes under severe conditions for a long period of time gives rise to a fear of the occurrence of various kinds of defects therein. Therefore, it is necessary to carry out a non-destructive inspection of heat exchanger tubes periodically, or at any time as the occasion demands.

Typical non-destructive inspection methods which have heretofore been carried out in practice include a visual inspection method, an ultrasonic wave inspection method, an eddy current inspection method and the like. The visual inspection method is a method of inserting an optical device, such as a reflecting mirror, a camera and the like in the vicinity of an object to be inspected, and observing the object directly or indirectly. The ultrasonic wave inspection method is a method of conducting flaw detection, thickness measurement and the like by sending an ultrasonic pulse toward an object to be inspected, receiving a reflected wave from an interface, etc. of the object, converting the received wave into an electric signal, and continuing observation of the electric signal for a given length of time. The eddy current inspection method is a method of determining the existence or non-existence of a defect and measuring the thickness of an object by supplying an AC current to a test coil, and detecting an eddy current induced by the object to be inspected, with reference to the variation of impedance of the coil. These non-destructive inspection methods are usually carried out from the inner side of a heat exchanger tube for the reason that the accessing to the object to be inspected is done easily.

However, these inspection methods have various problems that only an inner surface of the heat exchanger tube can be inspected, that a double tube or a triple tube having a clearance between an outer tube member and an inner tube member cannot be inspected, that a tube made of a magnetic material is difficult to inspect, and the like. Therefore, these inspection methods have to be selectively used in accordance with the material, construction and a portion of the heat exchanger tube to be inspected. As a result, an inspecting operation cannot be carried out fully satisfactorily in some cases, and an inspecting operation becomes complicated in other cases.

Further, these prior art inspection methods are directed to a single heat exchanger tube only, and are incapable of observing the whole of a group of heat exchanger tubes and diagnosing various kinds of defects thereof.

SUMMARY OF THE INVENTION

An object of the present invention is to provide an apparatus capable of non-destructively and easily inspecting a heat exchanger tube and a group of heat exchanger tubes for a defect, a wall thickness and the like regardless of the material and construction of the heat exchanger tube or of the condition of arrangement of a multiplicity of heat exchanger tubes.

According to the present invention, there is provided an apparatus for non-destructively inspecting an arbitrary heat exchanger tube among a group of heat exchanger tubes in which a multiplicity of heat exchanger tubes are arranged. The apparatus comprises a radiation detector inserted in a heat exchanger tube to be inspected, at least one radiation source inserted in a plurality of heat exchanger tubes surrounding the heat exchanger tube to be inspected, and a CT processing unit for subjecting radiation strength signals detected by the radiation detector to a CT processing, whereby a cross section of the heat exchanger tube to be inspected is imaged by the CT processing.

As heat exchanger tubes in which the radiation source is to be inserted, it is most simple to select heat exchanger tubes adjoining the heat exchanger tube to be inspected. However, as long as the radiation detector in the heat exchanger tube to be inspected can detect radiations transmitted through the heat exchanger tubes, the radiation source may be inserted in a heat exchanger tube disposed away from the heat exchanger tube to be inspected with other heat exchanger tubes interposed therebetween.

According to the present invention, there is also provided an apparatus for non-destructively inspecting an arbitrary heat exchanger tube among a group of heat exchanger tubes in which a multiplicity of heat exchanger tubes are arranged. The apparatus comprises a radiation detector inserted in a heat exchanger tube to be inspected, at least one radiation source set in the interior of a plurality of heat exchanger tubes and additionally disposed simulated heat exchanger tubes surrounding the heat exchanger tube to be inspected, and a CT processing unit for subjecting radiation strength signals detected by the radiation detector to a CT processing, whereby a cross section of the heat exchanger tube to be inspected is imaged by the CT processing.

The simulated heat exchanger tube may be, for example, a tubular body having the same outer shape and formed of the same material as the heat exchanger tube. The additional disposition of the simulated heat exchanger tubes is especially effective in the case where the heat exchanger tube disposed on the circumferentially outermost portion is inspected.

According to the present invention, there is further provided an apparatus for non-destructively inspecting an arbitrary heat exchanger tube among a group of heat exchanger tubes in a nuclear reactor plant in which a multiplicity of heat exchanger tubes are arranged. The apparatus comprises a radiation detector inserted in a heat exchanger tube to be inspected and a CT processing unit for subjecting radiation strength signals detected by the radiation detector to a CT processing, whereby radiations emitted from radioactive nuclides produced in a nuclear reactor coolant are detected by the radiation detector, and a cross section of the heat exchanger tube to be inspected is imaged by the CT processing.

When a group of heat exchanger tubes (for example, a heat exchanger, a steam generator and the like) are incorporated in a nuclear reactor plant, it is possible to directly utilize radiations emitted from radioactive nuclides (for example, sodium-22, sodium-24 and the like) in a coolant as a radiation source. These radioactive nuclides in the coolant are produced by nuclear reactions of coolant sodium and neutrons in the nuclear reactor.

According to the present invention, there is also provided an apparatus for non-destructively inspecting a group of heat exchanger tubes in which a multiplicity of heat exchanger tubes are arranged. The apparatus comprises at least one radiation source set in at least one of the positions selected from a position in an inner portion of the heat exchanger tube, a position on the inner side of the group of heat exchanger tubes or a position on the outer side of the group of heat exchanger tubes, at least one radiation detector carrying a collimator set in a position on the outer side of the group of heat exchanger tubes so that radiations emitted from the radiation source can be detected by the collimator-carrying radiation detector over substantially the whole circumference of the group of heat exchanger tubes, and a CT processing unit for subjecting radiation strength signals detected by the collimator-carrying radiation detector to a CT processing, whereby a cross section of the group of heat exchanger tubes is imaged by the CT processing.

According to the present invention, there is further provided an apparatus for non-destructively inspecting a group of heat exchanger tubes in a nuclear reactor plant in which a multiplicity of heat exchanger tubes are arranged, The apparatus comprises at least one radiation detector carrying a collimator set in a position on the outer side of the group of heat exchanger tubes so that radiations can be detected by the collimator-carrying radiation detector over substantially the whole circumference of the group of heat exchanger tubes, and a CT processing unit for subjecting radiation strength signals detected by the collimator-carrying radiation detector to a CT processing, whereby radiations emitted from radioactive nuclides produced in a nuclear reactor coolant are detected by the collimator-carrying radiation detector, and a cross section of the group of heat exchanger tubes is imaged by the CT processing.

A multiplicity of collimator-carrying radiation detectors may be set on the outer side of the group of heat exchanger tubes at substantially uniform intervals over substantially the whole circumference of the group of heat exchanger tubes. Alternatively, a single or a plurality of collimator-carrying radiation detectors may be set on the outer side of the group of heat exchanger tubes so that the collimator-carrying radiation detector can be moved in the circumferential direction of the group of heat exchanger tubes. In either case, transmission strength data of radiations can be obtained over the whole circumference of the group of heat exchanger tubes.

The "CT" generally means a method of obtaining a cross-sectional image of an object to be inspected by calculation based on measured values of projection amounts in various directions by utilizing X-rays, ultrasonic waves, various kinds of corpuscular rays and the like. In the present invention, radiations (X-rays or γ-rays) are utilized. The radiations sent out from radiation sources placed in various positions transmit an object to be inspected, and the transmitted radiations are detected by the radiation detector. Signals obtained by detecting the transmitted radiations are subjected to calculation in a computer, and the object to be inspected is thereby restructured as a cross-sectional image, which is then displayed.

In the present invention, when a driving mechanism capable of moving one or both of the radiation source and the radiation detector in the axial direction of the heat exchanger tube is provided, inspecting the heat exchanger tube in the axial direction thereof becomes possible. In the case of the group of heat exchanger tubes incorporated in the nuclear reactor plant, by providing a driving mechanism capable of moving the radiation detector in the axial direction of the heat exchanger tube, the inspection of the heat exchanger tube in the axial direction thereof becomes possible. As a result, it is possible to obtain cross-sectional images of the whole length of the heat exchanger tube or the group of heat exchanger tubes, continuously throughout the length thereof or intermittently at desired intervals of the length thereof.

PREFERRED EMBODIMENTS OF THE INVENTION

Figure 1A:
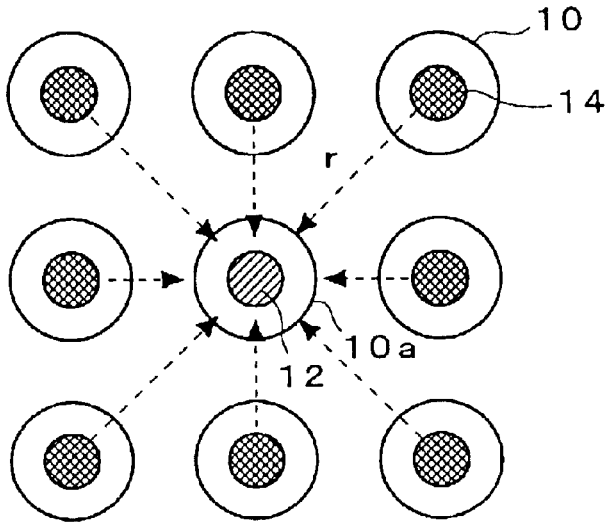
FIGS. 1A and 1B are explanatory drawings showing an embodiment of the apparatus for inspecting heat exchanger tubes according to the present invention.
Figure 1B:
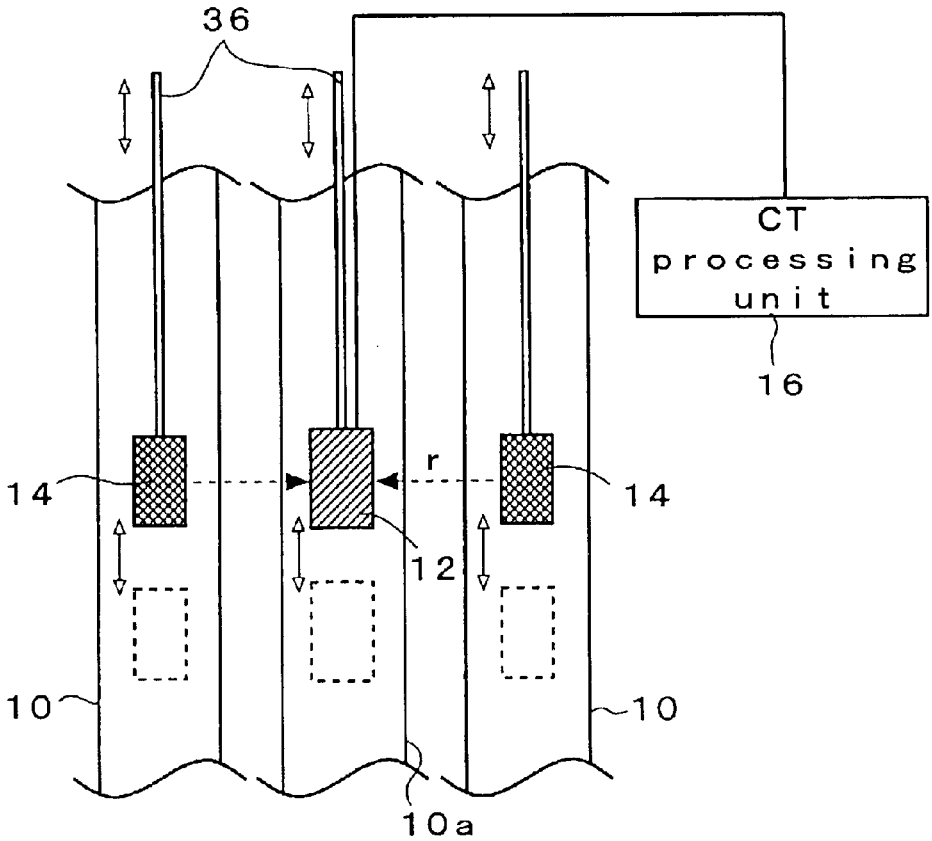

FIGS. 1A and 1B are explanatory drawings showing an embodiment of the apparatus for inspecting heat exchanger tubes according to the present invention, wherein FIG. 1A is a horizontal sectional view of the heat exchanger tubes; and FIG. 1B is a longitudinal sectional view thereof. This apparatus is adapted to non-destructively inspect an arbitrary heat exchanger tube by utilizing radiations (X-rays or γ-rays).

In the inside of a heat exchanger and a steam generator, a multiplicity of heat exchanger tubes 10 are incorporated in a regularly arranged state (which are called a group of heat exchanger tubes). The present invention provides the apparatus for inspecting a heat exchanger tube comprising a radiation detector 12 inserted in a heat exchanger tube to be inspected (a heat exchanger tube drawn in the center of FIG. 1, and this tube is shown specially by a reference numeral 10*a*), at least one radiation source 14 inserted in a plurality of heat exchanger tubes adjacent to and surrounding the heat exchanger tube 10*a* to be inspected, and a CT processing unit 16 adapted to subject transmission strength signals of the radiations, which are detected by the radiation detector 12, to the CT processing. A cross section of the heat exchanger tube 10*a* is imaged by this CT processing unit 16 in an arbitrary position in the axial direction of the heat exchanger tube 10*a*.

Figure 2A:
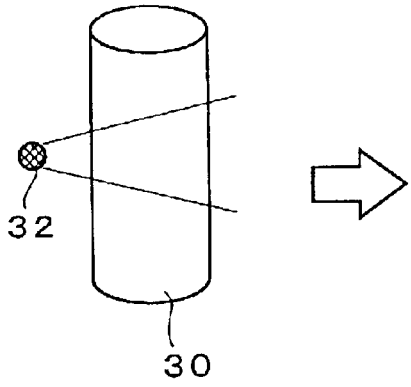
FIGS. 2A and 2B are drawings illustrating a CT processing operation.
Figure 2B:
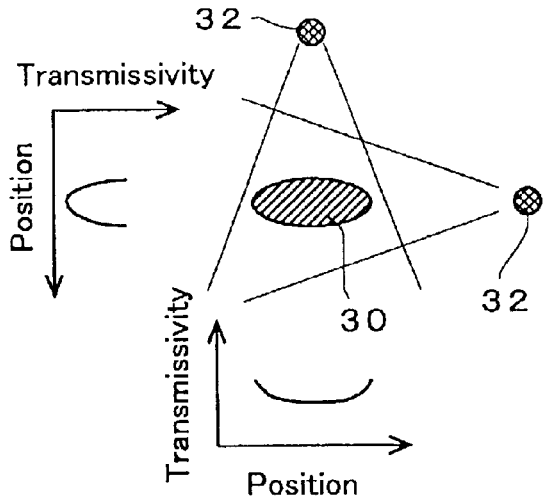

An outline of the CT processing is as follows. As shown in FIG. 2A, radiation sent out from a radiation source 32 is applied to an object 30 to be inspected in one direction. The transmissivity (or absorptivity) of the radiation which has transmitted through the object 30 is detected by a radiation detector. The transmissivity of the radiation becomes low in a thick portion of the object 30 to be inspected, and high in a thin portion thereof. As shown in FIG. 2B, when the transmissivity (or absorptivity) of a radiation which is applied to the object 30 in another direction is measured, the thickness, etc. of the object in its direction can be detected. This operation is carried out over the whole circumference of the object 30. When these data on the transmissivity (or absorptivity) are synthesized, a cross-sectional image of the object 30 in an arbitrary position can be obtained. This is a general description of the CT (Computed Tomography) method using radiations.

Returning to FIG. 1A, a heat exchanger tube 10*a* to be inspected (heat exchanger tube in which a radiation detector 12 is inserted) is adjoined and surrounded by eight heat exchanger tubes 10, and a radiation source 14 is inserted into the plurality of heat exchanger tubes 10 one by one, in order. The radiation (shown by an arrow r) sent out from the radiation source 14 transmits through the heat exchanger tube 10 in which the radiation source 14 is inserted and the heat exchanger tube 10*a* in which the radiation detector 12 is inserted, and is detected by the radiation detector 12. Since the radiation source 14 is inserted one by one, in order, into the heat exchanger tubes 10 which surround substantially the whole circumference of the heat exchanger tube 10*a* to be inspected, the radiations transmitted through substantially the whole circumference of the heat exchanger tube 10*a* can be detected by the radiation detector 12. When transmission strength signals of all the radiations thus detected are processed in a CT processing unit 16, a cross section of the heat exchanger tube 10*a* to be inspected can be imaged in an arbitrary position in the axial direction thereof. The heat exchanger tube 10*a* can be inspected for a defect, etc. on the basis of the obtained image.

When the radiation detector 12 is then inserted into another heat exchanger tube to be inspected and the radiation source 14 is inserted one by one, in order, into the other heat exchanger tubes surrounding the radiation detector-containing heat exchanger tube, a cross section of the radiation detector-containing heat exchanger tube can be imaged. By inserting the radiation detector 12 one by one in order into all the heat exchanger tubes that are to be inspected and carrying out such an operation as described above, cross sections of all the heat exchanger tubes to be inspected can be imaged, so that all the tubes can be inspected for defects, etc. In the apparatus according to the present invention, a plurality of radiation sources 14 may be inserted into the respective heat exchanger tubes 10 adjoining and surrounding the heat exchanger tube 10*a* to be inspected. In this case, the radiation detector 12 inserted in the heat exchanger tube 10*a* detects the radiations sent out from the radiation sources 14 one by one, in order.

As shown in FIG. 1B, when the radiation detector 12 and the radiation source 14 are moved synchronously to arbitrary vertical positions by a vertically driving mechanism 36, the radiations which have transmitted through the heat exchanger tubes can be detected in these vertical positions. Accordingly, when an operation for subjecting strength signals of the transmitted radiations to the CT processing is carried out continuously or intermittently at suitable intervals over the whole length of the heat exchanger tubes, a cross section of the heat exchanger tubes in the respective positions in the axial direction thereof can be imaged. Such operations enable the images of the heat exchanger tubes as a whole to be obtained and the defect inspection to be carried out in the heat exchanger tubes utilizing the images thus obtained.

Figure 3:
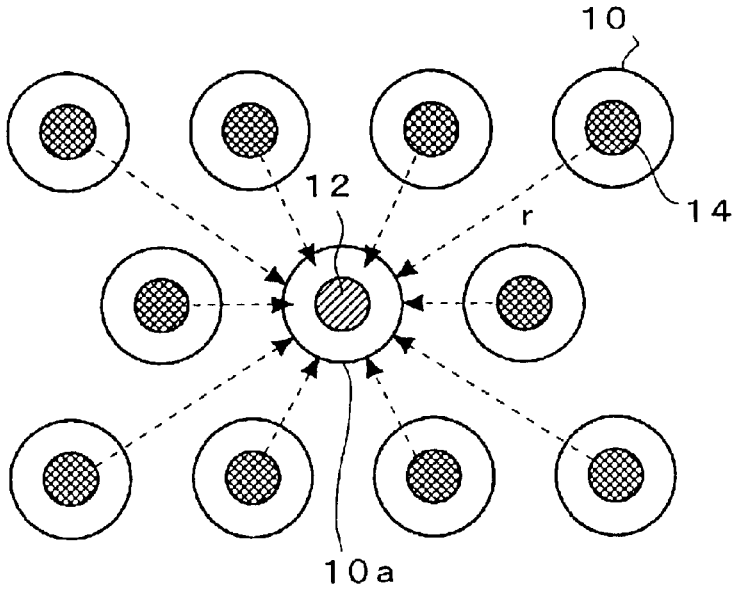
FIG. 3 is an explanatory drawing showing another embodiment of the apparatus for inspecting heat exchanger tubes according to the present invention.
Figure 4:
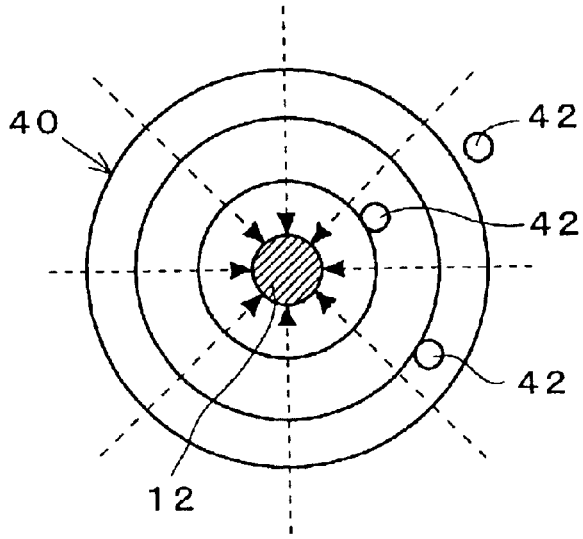
FIG. 4 is an explanatory drawing showing an example in which the present invention is applied to the inspection of a multiplex heat exchanger tube.

FIG. 3 shows an example in which the arrangement of the heat exchanger tubes is changed. The present invention employs a system having the radiation detector 12 inserted in an inner portion of the heat exchanger tube 10*a* to be inspected, and at least one radiation source 14 inserted into inner portions of a plurality of other heat exchanger tubes 10 surrounding the tube 10*a* to be inspected. Therefore, no matter how the arrangement of the heat exchanger tubes is changed, an operation for inspecting the heat exchanger tubes can be carried out correspondingly without any trouble. Since the present invention also employs a system for detecting transmitted radiations, the invention can be applied to a group of heat exchanger tubes each of which is made of a multiplex tube, such as a double tube and a triple tube. FIG. 4 shows an example of a heat exchanger tube 40 having a triple structure. As shown in FIG. 4, the radiation detector 12 is inserted into the inside of an innermost tube member. The present invention can also be applied to a case where other structural members 42 (for example, support members and the like for the heat exchanger tube) are disposed in a clearance between tube members constituting the heat exchanger tube 40 of the triple structure or between adjacent heat exchanger tubes.

Figure 5:
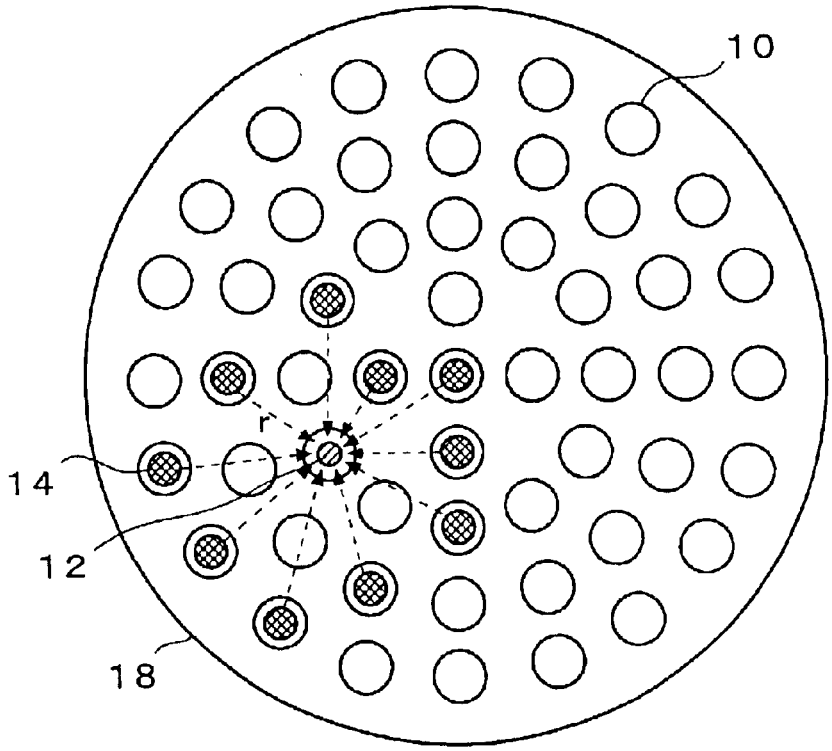
FIG. 5 is an explanatory drawing showing still another embodiment of the apparatus for inspecting heat exchanger tubes according to the present invention.

The above embodiment describes a case where the radiation source is inserted into the heat exchanger tubes adjacent to the heat exchanger tube in which the radiation detector is inserted. However, as long as the transmission strength data of the radiations are obtained over the whole circumference of the heat exchanger tube in which the radiation detector is inserted, the heat exchanger tubes in which the radiation source 14 is inserted may not necessarily be adjacent to the heat exchanger tube 12 in which the radiation detector 12 is inserted, as shown in FIG. 5.

When the heat exchanger tubes are arranged in this manner, it becomes possible to image the cross sections of the heat exchanger tube in which the radiation detector 12 is inserted and the surrounding heat exchanger tubes by CT processing, and inspect a plurality of heat exchanger tubes at once. A reference numeral 18 denotes a cylindrical container in which a group of heat exchanger tubes are housed.

Figure 6:
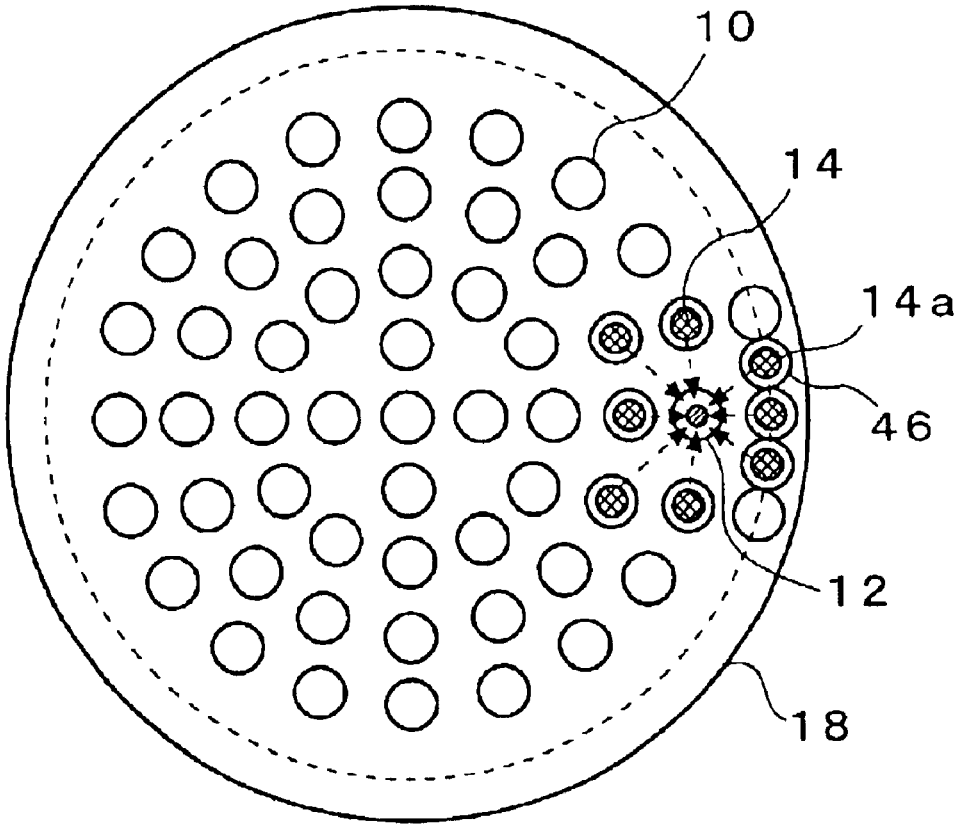
FIG. 6 is an explanatory drawing showing a further embodiment of the apparatus for inspecting heat exchanger tubes according to the present invention.

FIG. 6 shows an example of a case where a circumferentially outermost heat exchanger tube is inspected. When the circumferentially outermost heat exchanger tube is inspected, the radiation source can be inserted in a heat exchanger tube adjacent to and on the inner side of the heat exchanger tube to be inspected, but the radiation source cannot be inserted in a heat exchanger tube on the outer side of the heat exchanger tube to be inspected since a heat exchanger tube does not exist on the outer side of the heat exchanger tube to be inspected. Therefore, when the heat exchanger tubes are left as they are, the transmission strength data of the radiation over the whole circumference of the heat exchanger tube to be inspected cannot be obtained. Under these circumstances, between a group of heat exchanger tubes consisting of a multiplicity of heat exchanger tubes 10 and the cylindrical container 18 surrounding these heat exchanger tubes 10, a multiplicity of auxiliary simulated heat exchanger tubes 46, the outer shape and material of which are the same as those of the tubes 10, are disposed, and the radiation source 14*a* is inserted into the inner portions of the simulated heat exchanger tubes 46. The radiation source may, of course, be inserted directly in the cylindrical container 18 without using the simulated heat exchanger tubes 46. Since the arrangement using the simulated heat exchanger tubes 46 can always maintain the interior of the simulated heat exchanger tubes in a liquid-less state, the arrangement is effective, especially when the cylindrical container 18 is filled with a liquid. When there is not a sufficient space between the group of heat exchanger tubes and the cylindrical container, the radiation source may be disposed on the outer side of the cylindrical container.

In the inspection of the heat exchanger tube carried out by the apparatus according to the present invention, there may be used a method of inserting the radiation source one by one into the heat exchanger tubes around the radiation detector-containing heat exchanger tube to be inspected, and detecting in order the radiations sent out from the specific directions by the radiation detector. Alternatively, there may be also used a method of inserting the radiation source into one heat exchanger tube and detecting the radiations at a plurality of positions on the whole circumference of the radiation source-containing heat exchanger tube by using a radiation detector carrying a collimator.

Figure 7A:
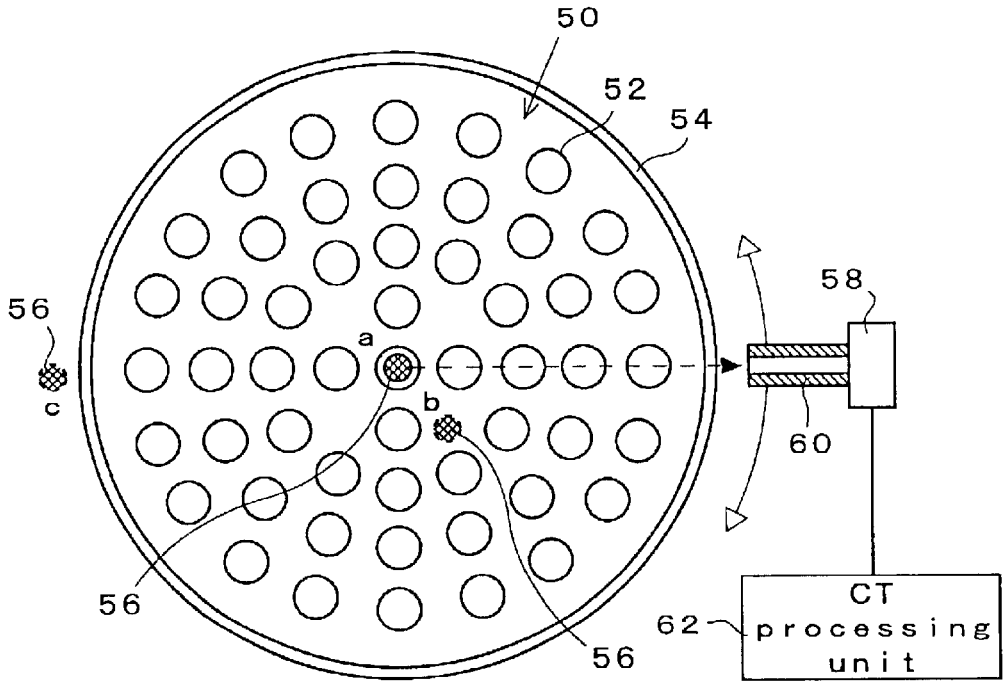
FIGS. 7A and 7B are explanatory drawings showing an embodiment of the apparatus for inspecting a group of heat exchanger tubes according to the present invention.
Figure 7B:
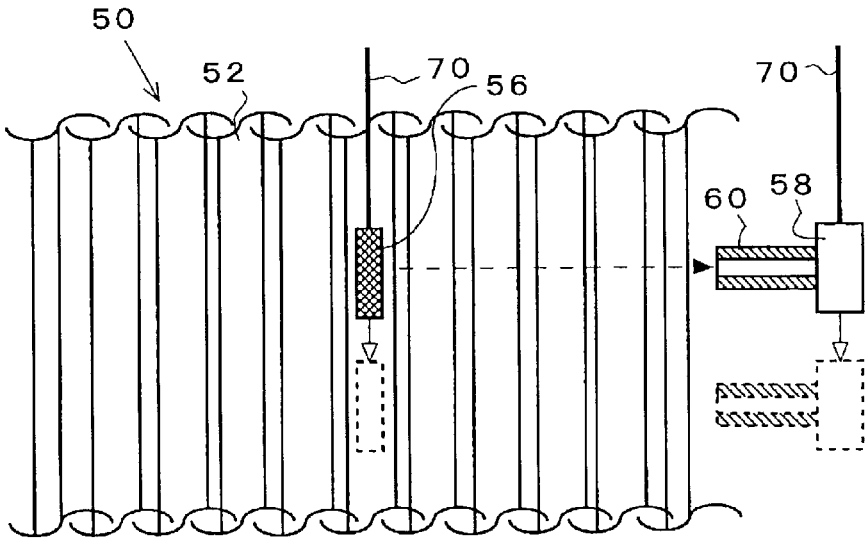

FIGS. 7A and 7B are explanatory drawings showing an embodiment of the apparatus for inspecting a group of heat exchanger tubes according to the present invention, wherein FIG. 7A illustrates a horizontal section of a group of heat exchange tubes; and FIG. 7B illustrates a longitudinal section thereof. This apparatus is adapted to non-destructively inspect a group of heat exchanger tubes as a unit by utilizing radiations (X-rays or γ-rays).

The group 50 of heat exchanger tubes has a structure in which a multiplicity of vertically extending heat exchanger tubes 52 are arranged regularly and bundled with a suitable distance kept from one another, and these heat exchanger tubes 52 are incorporated in a cylindrical container 54. The radiation source 56 can be set in an inner portion of an arbitrary heat exchanger tube (for example, a position designated by a reference letter a), in an arbitrary position on the inner side of the group of heat exchanger tubes (for example, a position designated by a reference letter b), or in an arbitrary position on the outer side of the group of heat exchanger tubes (for example, a position designated by a reference letter c). When measurement is conducted in practice, the radiation source 56 is inserted into one of the positions of the interior of the heat exchanger tube, the inside of the group of heat exchanger tubes or the outside of the same group in accordance with the actual condition, and not into all of these positions at the same time. FIGS. 7A and 7B show an example in which the radiation source 56 is inserted into the interior of the central heat exchanger tube as shown by a solid line.

On the outer side of the cylindrical container 54, namely on the outer side of the group of heat exchanger tubes, a radiation detector 58 is set so that the radiations can be detected in an arbitrary position over substantially the whole circumference of the cylindrical container 54. This radiation detector 58 is formed so that a detecting surface thereof faces to the group of heat exchanger tubes with a cylindrical collimator 60 attached to the front side of the detecting surface thereof. Owing to the collimator-carrying radiation detector 58 described above, only the radiations that enter the collimator 60 along the axis thereof are selectively detected. Radiation strength signals detected by the radiation detector 58 is sent to a CT processing unit 62 and subjected to the CT processing, to thereby image a cross section of the group of heat exchanger tubes at an arbitrary position.

The radiations sent out from the radiation source 56 transmit through the group 50 of heat exchanger tubes consisting of a multiplicity of heat exchanger tubes 52, and through the cylindrical container 54 surrounding the group of tubes. In the radiation detector 58, only the transmitted radiations that have passed through the collimator 60 in a predetermined direction are detected. A multiplicity of collimator-carrying radiation detectors 58 may be arranged in a substantially uniformly distributed state around the whole circumference of the cylindrical container 54, or a single or a plurality of collimator-carrying radiation detectors may be moved properly over the whole circumference of the cylindrical container 58. Thus, the radiations transmitted through the group of heat exchanger tubes in various directions with respect thereto are detected by the collimator-carrying radiation detector or detectors 58.

The position of each heat exchanger tube 52 is already known, and those of the radiation source 56 and radiation detector 58 can be determined, so that the path along which the radiations detected by the radiation detector 58 is known. Owing to the use of the multiple distributed radiation detectors or the movement of a single radiation detector, a multiplicity of signals of radiations transmitted through the group 50 of the heat exchanger tubes to be inspected are obtained. The detected signals are line integrals of attenuation with respect to the radiations transmitted through a propagation path. Therefore, when the signals in all directions which are detected by the radiation detector 58 are subjected to the CT processing, a horizontal section of the group of heat exchanger tubes can be imaged. This image enables the inspection of the heat exchanger tubes for a defect to be carried out.

As shown in FIG. 7B, when the radiation source 56 and the radiation detector 58 are moved to arbitrary vertical positions by a vertically driving mechanism 70, strength signals of the radiations transmitted through the heat exchanger tubes in these vertical positions can be detected. By carrying out an operation for subjecting the signal to the CT processing at suitable intervals along the vertical length of the group of heat exchanger tubes, a cross section of the group of heat exchanger tubes at the respective positions in the axial direction of the heat exchange tubes can be imaged. Thus, it becomes possible to image the group of heat exchanger tubes as a whole, and carry out the defect inspection of the heat exchanger tubes by utilizing these images.

Figure 8:
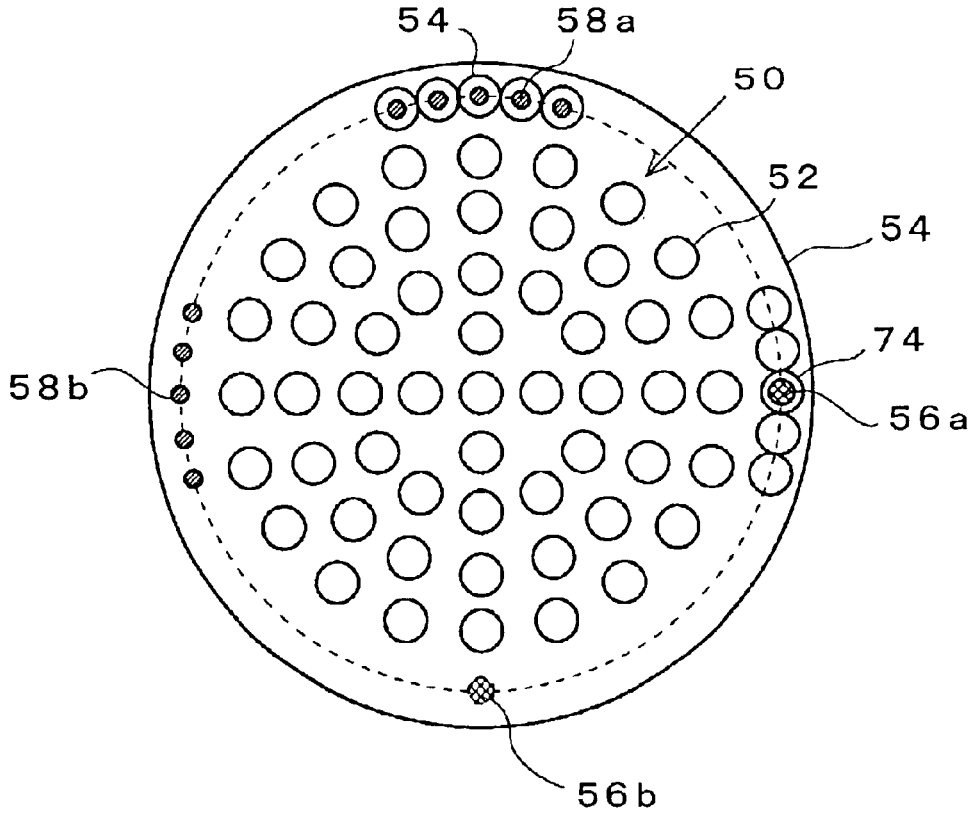
FIG. 8 is an explanatory drawing showing another embodiment of the apparatus for inspecting a group of heat exchanger tubes according to the present invention.

Although the radiation detector 58 is disposed on the outer side of the cylindrical container 54 surrounding the group of heat exchanger tubes 52 in the above-described embodiment, such a radiation detector may also be disposed in a space between the group of heat exchanger tubes and the cylindrical container under a certain condition. An example of such a case is shown in FIG. 8. In this case, auxiliary measuring tubes 74 the shape of which is identical with that of the heat exchanger tubes 52 are inserted in a space between the group 50 of heat exchanger tubes consisting of a multiplicity of heat exchanger tubes 52 and the cylindrical container 54, and the radiation source 56*a* or the radiation detector 58*a* may be inserted in the interior of the measuring tube 74. Alternatively, the radiation source 56*b* and the radiation detector 58*b* may be inserted directly in the space without using the measuring tubes. In the arrangement using the measuring tubes 74, the interior of the measuring tubes 74 can always be maintained in a liquid-less condition, so that this arrangement is effectively used, especially in a case where the interior of the cylindrical container 54 is filled with a liquid.

Figure 9:
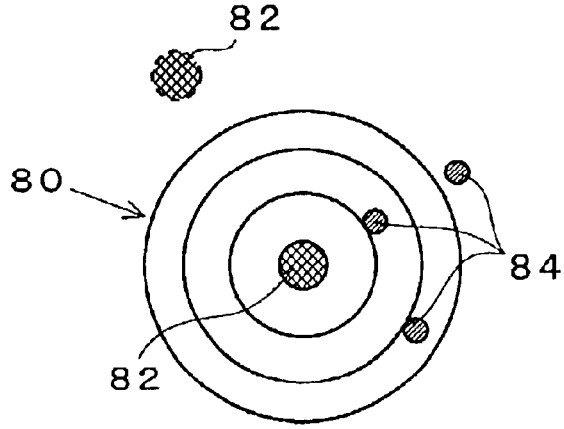
FIG. 9 is an explanatory drawing showing an example in which the present invention is applied to the inspection of a multiplex tube.

The present invention is directed to a system for detecting radiations which have transmitted through a heat exchanger tube, and can therefore be applied to an inspection of a group of heat exchanger tubes each of which is formed of a multiplex tube, such as a double tube and a triple tube. FIG. 9 shows an example of a heat exchanger tube 80 which has a triple structure. A radiation source 82 is inserted in the interior of an innermost tube member of the tube 80, or on the outer side of an outermost tube member. The present invention can also be applied to even a case where other structural members 84 (for example, support members for the heat exchanger tubes) are disposed in a clearance between tube members constituting the heat exchanger tube of the triple structure, or between adjacent heat exchanger tubes.

In the apparatus according to the present invention, no problem arises basically even when the radiation source is set only in the interior of the heat exchanger tube, only on the inner side of the group of heat exchanger tubes, or only on the outer side of the group of heat exchanger tubes. However, in the following condition, the position in which the radiation source is set poses problems in some cases, so that it is necessary to designate the position in which the radiation source is set.

(1) When the cylindrical container surrounding heat exchanger tubes or a group of heat exchanger tubes is filled with a liquid, for example, during an operation of a plant, it is necessary to set the radiation source on the outer side of the group of heat exchanger tubes.

(2) When the interior of the heat exchanger tube is filled with a liquid but the interior of the cylindrical container is not, the radiation source may be set either on the inner side of the group of heat exchanger tubes or on the outer side thereof.

(3) When the interior of the cylindrical container is filled with a liquid but the interior of the heat exchanger tube is not, the radiation source may be set either in the heat exchanger tube or on the outer side of the group of heat exchanger tubes.

(4) When neither the interior of the heat exchanger tube nor that of the cylindrical container is filled with a liquid, the radiation source may be set in any position.

In order to practically use the apparatus according to the present invention, a radiation source is set on the outer side of the group of heat exchanger tubes first, and the group of heat exchanger tubes as a whole is then imaged. Then attention is paid to a heat exchanger tube which is likely to have a defect. In order to observe this heat exchanger tube more thoroughly, a liquid is discharged, a radiation source is inserted on the inner side of the group of heat exchanger tubes, and the inspection of the heat exchanger tubes is then conducted. In order to obtain a cross sectional image of the group of heat exchanger tubes by carrying out a CT processing operation, it is necessary to obtain transmission strength data of the radiations (X-rays or γ-rays) over the whole circumference of the group of heat exchanger tubes. Therefore, when the radiation source is inserted in any position of the interior of the heat exchanger tube, on the inner side of the group of heat exchanger tubes or on the outer side of the group of heat exchanger tubes, the necessary data can be obtained by conducting measurements repeatedly with the positions of the radiation source and the radiation detector changed variously.

The defects of a heat exchanger tube which can be detected by the apparatus according to the present invention include a decrease in the wall thickness and a pinhole occurring due to the corrosion caused by a liquid, cracks in the heat exchanger tube occurring due to vibration, etc., and other similar defects. Specifically, a defect of around several $10^{-1}$ mm can be detected by the apparatus according to the present invention.

In each of the above-described embodiments, a radiation source is provided. However, when a group of heat exchanger tubes are incorporated in a nuclear reactor plant, it is possible to directly utilize radiations emitted from radioactive nuclides (for example, sodium-22, sodium-24 and the like) in a coolant as a radiation source. These radioactive nuclides in the coolant are produced by nuclear reactions of coolant sodium and neutrons in the nuclear reactor. Therefore, since it is unnecessary to set a radiation source additionally, the constitution of the apparatus is more simplified. This structure can be applied to both a case where a heat exchanger tube is inspected and a case where a group of heat exchanger tubes as a whole are inspected collectively.

As described above, the apparatus according to the present invention includes a radiation detector inserted in a heat exchanger tube to be inspected, radiation sources inserted in a plurality of other heat exchanger tubes surrounding the heat exchanger tube to be inspected, and a CT processing unit for subjecting radiation strength signals detected by the radiation detector to CT processing. Thereby, a cross section of the heat exchanger tube to be inspected is imaged by the CT processing. With such an arrangement, the inspection of a heat exchanger tube for various defects and wall thickness thereof can be carried out easily, irrespective of the material and structure of the heat exchanger tube or the condition of arrangement of a multiplicity of heat exchanger tubes.

Further, the apparatus according to the present invention comprises a radiation source set in the interior of a heat exchanger tube, on the inner side of a group of heat exchanger tubes, or on the outer side of the group of heat exchanger tubes, a collimator-carrying radiation detector set on the outer side of the group of heat exchanger tubes so that the radiations can be detected on the outer side of the group of heat exchanger tubes and over substantially the whole of a circumference of the group of heat exchanger tubes, and a CT processing unit for subjecting radiation strength signals detected by the radiation detector to the CT processing. Thereby, a cross section of the group of heat exchanger tubes is imaged by the CT processing. With such an arrangement, the inspection of a multiplicity of heat exchanger tubes as a unit for various defects and wall thickness can be conducted in practice easily, irrespective of the material and structure of the heat exchanger tubes or the condition of arrangement of the multiple heat exchanger tubes.

What is claimed is:

1. An apparatus for non-destructively inspecting an arbitrary heat exchange tube among a group of heat exchanger tubes in which a multiplicity of heat exchange tubes are arranged, the apparatus comprising:

a radiation detector inserted in a heat exchanger tube to be inspected, at least one radiation source set in the interior of a plurality of heat exchanger tubes and additionally disposed simulated heat exchanger tubes surrounding the heat exchanger tube to be inspected, and a CT processing unit for subjecting radiation strength signals detected by the radiation detector to a CT processing, whereby a cross section of the heat exchanger tube to be inspected is imaged by the CT processing.

2. An apparatus for non-destructively inspecting a group of heat exchanger tubes as a unit comprising a multiplicity of heat exchanger tubes arranged in a container, the apparatus comprising: at least one radiation source set in at least one of the positions selected from a position in an inner portion of one of the heat exchanger tubes or a position on the inner side of the group of heat exchanger tubes in the container, at least one radiation detector carrying a collimator set in a position on the outer side of the container so that radiations emitted from the radiation source can be detected by the collimator-carrying radiation detector over substantially the whole circumference of the container, and a CT processing unit for subjecting radiation strength signals detected by the collimator-carrying radiation detector to a CT processing, whereby a cross section of the group of heat exchanger tubes is imaged by the CT processing, wherein a plurality of collimator-carrying radiation detectors are set on the outer side of the container at substantially uniform intervals over substantially the whole circumference of the container.

3. An apparatus for non-destructively inspecting a group of heat exchanger tubes as a unit comprising a multiplicity of heat exchanger tubes arranged in a container, the apparatus comprising: at least one radiation source set in at least one of the positions selected from a position in an inner portion of one of the heat exchanger tubes or a position on the inner side of the group of heat exchanger tubes in the container, at least one radiation detector carrying a collimator set in a position on the outer side of the container so that radiations emitted from the radiation source can be detected by the collimator-carrying radiation detector over substantially the whole circumference of the container, and a CT processing unit for subjecting radiation strength signals detected by the collimator-carrying radiation detector to a CT processing, whereby a cross section of the group of heat exchanger tubes is imaged by the CT processing, wherein at least one collimator-carrying radiation detector is set on the outer side of the container and is adapted to be movable so that the collimator-carrying radiation detector can be moved in the circumferential direction of the container.

4. An apparatus for non-destructively inspecting a group of heat exchanger tubes as a unit comprising a multiplicity of heat exchanger tubes arranged in a container in a nuclear reactor plant, the apparatus comprising: at least one radiation detector carrying a collimator set in a position on the outer side of the container so that radiations can be detected by the collimator-carrying radiation detector over substantially the whole circumference of the container, and a CT processing unit for subjecting radiation strength signals detected by the collimator-carrying radiation detector to a CT processing, whereby radiations emitted from radioactive nuclides produced in a nuclear reactor coolant are detected by the collimator-carrying radiation detector, and a cross section of the group of heat exchanger tubes is imaged by the CT processing, wherein a plurality of collimator-carrying radiation detectors are set on the outer side of the container at substantially uniform intervals over substantially the whole circumference of the container.

5. An apparatus for non-destructively inspecting a group of heat exchanger tubes as a unit comprising a multiplicity of heat exchanger tubes arranged in a container in a nuclear reactor plant, the apparatus comprising: at least one radiation detector carrying a collimator set in a position on the outer side of the container so that radiations can be detected by the collimator-carrying radiation detector over substantially the whole circumference of the container, and a CT processing unit for subjecting radiation strength signals detected by the collimator-carrying radiation detector to a CT processing, whereby radiations emitted from radioactive nuclides produced in a nuclear reactor coolant are detected by the collimator-carrying radiation detector, and a cross section of the group of heat exchanger tubes is imaged by the CT processing, wherein at least one collimator-carrying radiation detector is set on the outer side of the container and is adapted so that the collimator-carrying radiation detector can be moved in the circumferential direction of the container.

* * * * *